US005920930A

United States Patent [19]

Harrow

[11] Patent Number: 5,920,930

[45] Date of Patent: Jul. 13, 1999

[54] LOCKING DEVICE FOR A BOXSPRING SUPPORT RAIL AND METHOD

[76] Inventor: Lawrence Harrow, 945 S. Birch St., Los Angeles, Calif. 90021

[21] Appl. No.: 08/873,862

[22] Filed: Jun. 12, 1997

[51] Int. Cl.[6] ..... A47C 19/02

[52] U.S. Cl. ..... 5/201; 5/200.1; 5/286; 5/411

[58] Field of Search ..... 5/200.1, 201, 206, 5/282.1, 285, 286, 207, 411

[56] References Cited

U.S. PATENT DOCUMENTS

| | | | |
|---|---|---|---|
| Re. 29,611 | 4/1978 | Lawrence | 5/200.1 |
| 3,605,142 | 9/1971 | Weinhart | 5/282.1 X |
| 4,196,484 | 4/1980 | Harris | 5/286 X |
| 4,536,904 | 8/1985 | Whitehead | 5/286 X |
| 4,554,692 | 11/1985 | Whitehead | 5/411 |

*Primary Examiner*—Brian K. Green
*Assistant Examiner*—Robert G. Santos
*Attorney, Agent, or Firm*—John J. Connors; Connors & Assoc.

[57] ABSTRACT

A support rail for a boxspring includes a cross bar having opposed ends, and a bracket attached to each end. Each bracket has a gripper arm and is mounted to move laterally across the end to which it is attached between an extended position and a retracted position. An end section of each of end of the cross bar and a connection section of each of the brackets is made of a malleable material, from which a lock mechanism is formed to releasably interlocked together the cross bar and brackets when the brackets are in the retracted position. The lock mechanism includes a locking element and a receptacle, with the receptacle formed in either the bracket or the cross bar and the locking element formed in either bracket or the cross bar depending on the position of the receptacle. The locking element has a predetermined configuration with a sloping portion that facilitates moving the bracket in one direction from the extended position to the retracted position and a stop portion that engages the receptacle and inhibits moving the bracket in the reverse direction from the retracted position to the extended position.

11 Claims, 4 Drawing Sheets

FIG. 2A
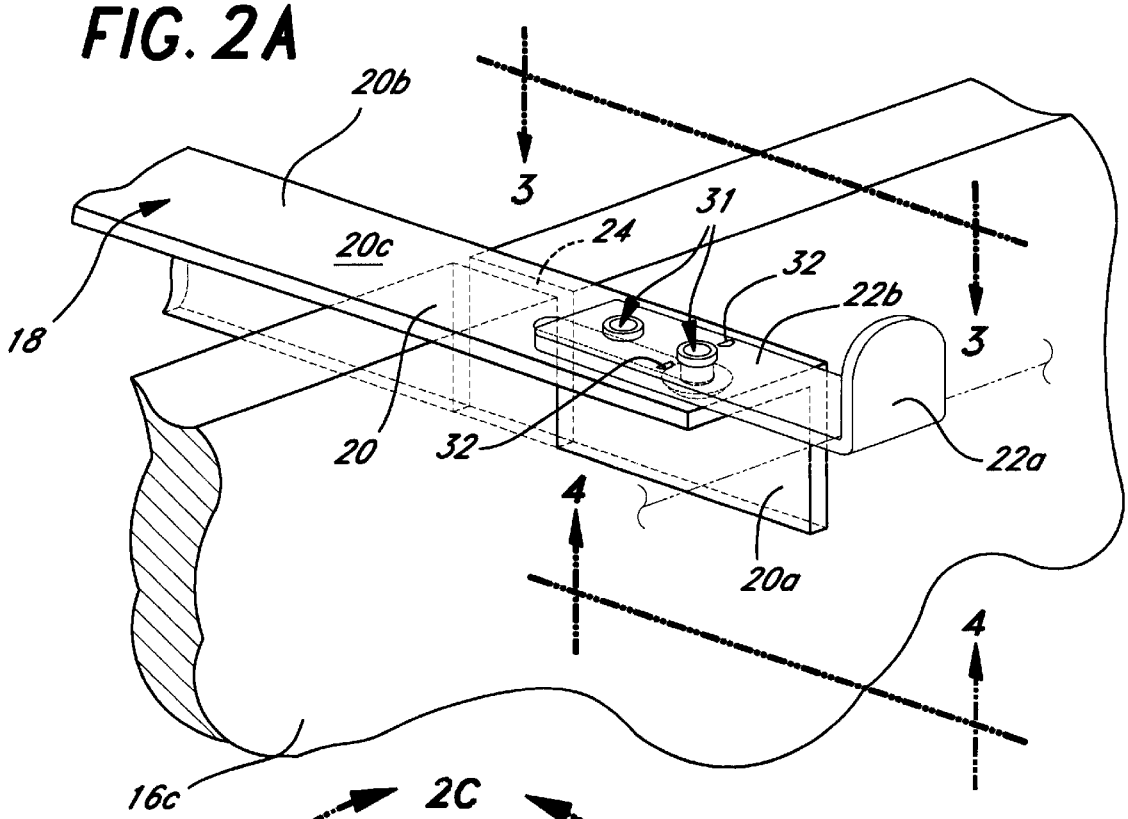
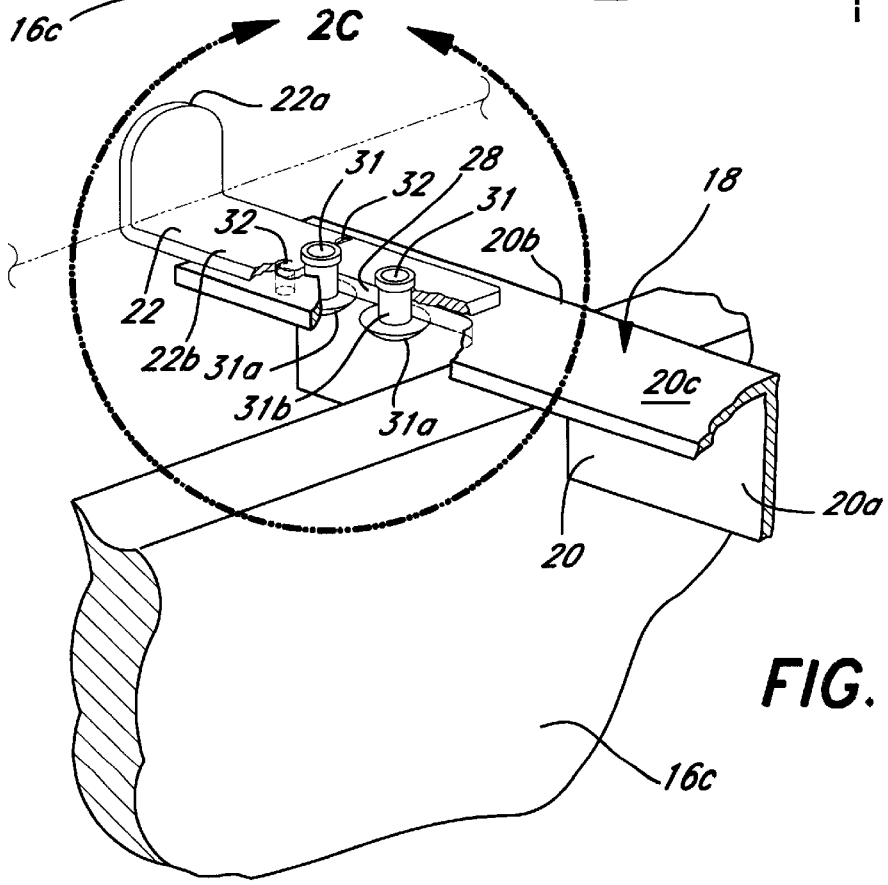
FIG. 2B

FIG. 3
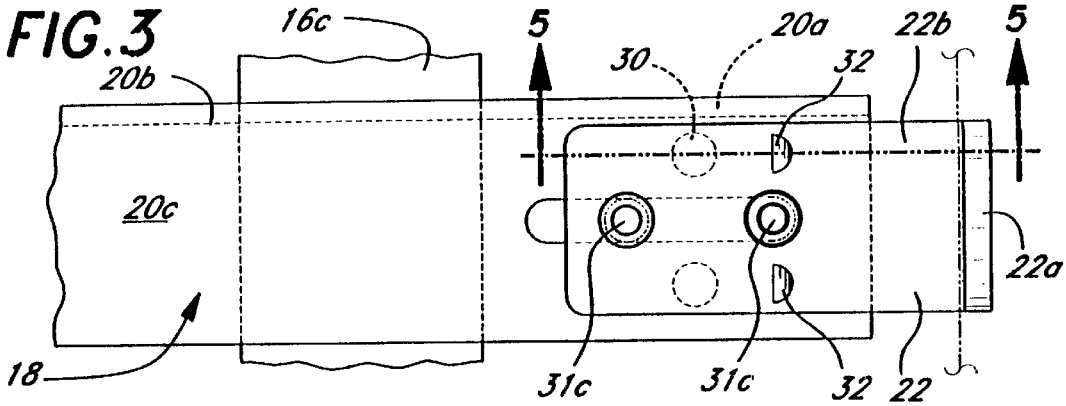
FIG. 5
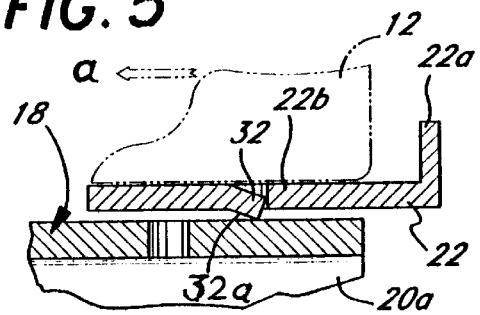
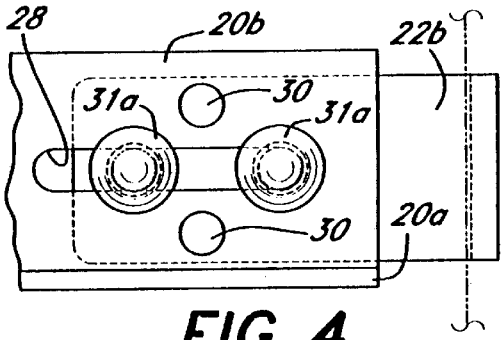
FIG. 4
FIG. 6
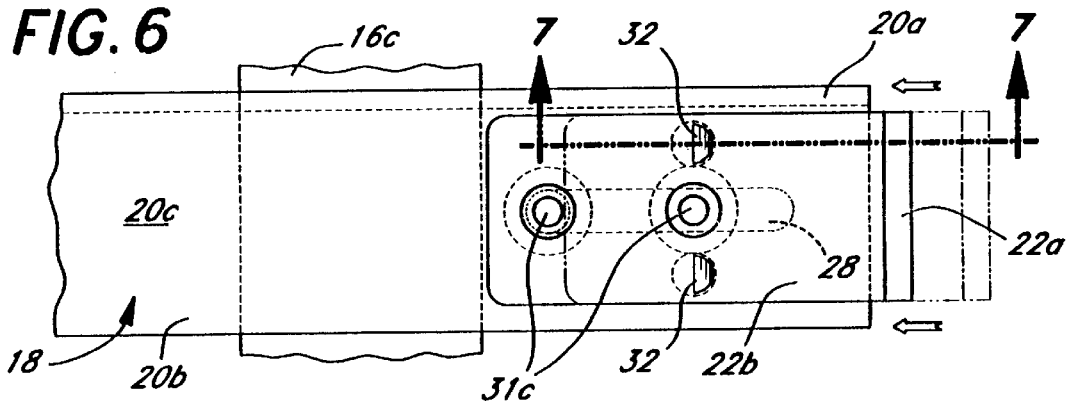
FIG. 7
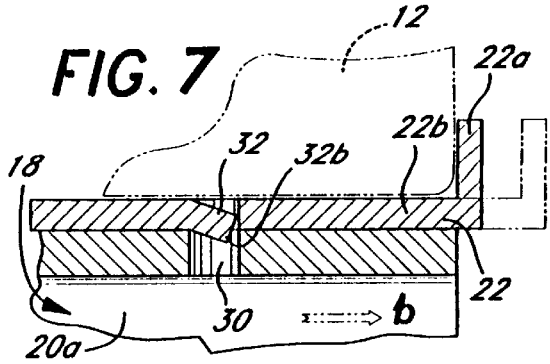
FIG. 8
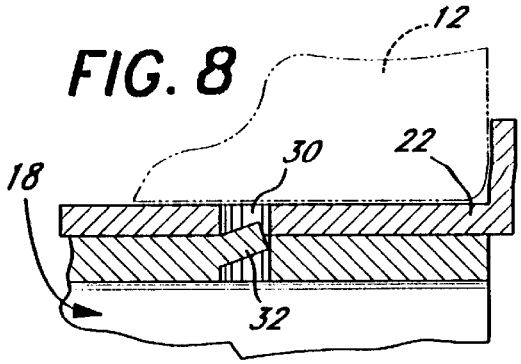

LOCKING DEVICE FOR A BOXSPRING SUPPORT RAIL AND METHOD

BACKGROUND OF THE INVENTION

1. Field of the Invention

This invention relates to a support rail for a boxspring, and particularly to one which has moveable brackets at the ends of a cross bar with each bracket having a reliable locking mechanism which is simple to manufacture.

2. Background Discussion

Bed supports are commonly employed to elevated and support a boxspring and mattress carried by the boxspring. One type of bed support is a simple, wooden rectangular frame with a head board, a foot board, and opposed sides board connecting the foot and head boards. Typically, two or three support rails extend across the top of the frame between its opposed side boards. There are at opposite ends of the support rails adjustable brackets which move between extended and retracted positions. In the extended positions, the distance between the brackets is slightly greater than the width of the boxspring. With the brackets in the extended positions, the boxspring is centrally positioned on the support rails between the brackets. The brackets are then moved to their retracted positions, engaging opposite sides of the boxspring. A manually releasable locking mechanism is sometimes employed to keep the brackets in the retracted position until the boxspring is removed from the bed support. Such locking mechanism may include a spring with a finger that fits into a hole when the bracket is moved to the retracted position. If the spring is bent, which often happens, the finger becomes misaligned with the hole and the locking mechanism fails.

SUMMARY OF THE INVENTION

It is the objective of this invention to provide a reliable locking mechanism for a support rail which is highly unlikely to fail.

This invention has several features, no single one of which is solely responsible for its desirable attributes. Without limiting the scope of this invention as expressed by the claims which follow, its more prominent features will now be discussed briefly. After considering this discussion, and particularly after reading the section entitled, "DETAILED DESCRIPTION OF THE PREFERRED EMBODIMENTS," one will understand how the features of this invention provide its benefits, which include (1) simplicity of manufacture, (2) no nuts, bolts or loose parts, (3) reliable performance without using springs or other parts which are easily damaged or broken, and (4) ease of use.

The first feature of the boxspring support rail of this invention is a cross bar having opposed ends with a bracket attached to each end. Each bracket has a gripper arm and each bracket is mounted to move laterally across the end to which it is attached between an extended position and a retracted position. The ends of the cross bar and a connection section of each of the brackets is made of a malleable material, such as, for example, steel. Preferably, both the cross bar and the brackets each have an L-shaped configuration.

The second feature is that the cross bar and brackets are releasably interlocked together when the brackets are in the retracted positions by a lock mechanism at each end of the cross bar. Each lock mechanism includes a locking element and a receptacle. The receptacle is formed in the malleable material of the cross bar or in the malleable material of the bracket. The locking element is formed in the malleable material of the other component. For example, if at one end of the cross bar the locking element is formed in the cross bar, the receptacle is formed in the bracket, and vice versa. Preferably, each receptacle is a hole in the component in which it is formed. The locking element extends outward and is received in the receptacle when the brackets are moved into their retracted positions. Each receptacle and its corresponding locking element at each opposed end of the cross bars are in predetermined locations, so that with each bracket in the retracted position each locking element is received in its corresponding receptacle and the distance between the brackets is approximately equal to the width of the boxspring. The locking elements have a predetermined configuration with a sloping portion that facilitates moving the bracket in one direction from the extended position to the retracted position and a stop portion that engages the receptacle and inhibits moving the bracket in the reverse direction from the retracted position to the extended position. In accordance with this invention, the brackets each a gripper arm, and when the brackets are in the retracted positions, the gripper arms engage the boxspring and the boxspring bears down on the bracket to tend to maintain the locking element in the receptacle.

The third feature is that the cross bar has a predetermined thickness and an underside and there is an elongated slot in each end of the cross bar extending lengthwise along a portion of the length of the cross bar. At least one rivet member extends from a connection section of each bracket. Each rivet member has an enlarged head adjacent the underside of the cross bar and a connecting member extending into and through its respective slot to enable the bracket to move reciprocally in the slot between the extended position and retracted position. The connecting member is slightly longer than the thickness of the cross bar so that the bracket may be moved a slight distance towards and away from the end to which it is attached to assist in disengaging the locking element from the receptacle.

This invention also includes a method for supporting on a bed support a boxspring with a predetermined width defined by opposed sides. This method includes:

(a) providing a pair of support rails that extend across the bed support, each support rail including a cross bar having a substantially L-shaped configuration with a first leg member adapted to be removably inserted into a pair of opposed aligned slots in the bed support and a second leg member attached to the first leg member at substantially a right angle to the first leg member and having an underside which lies on top of and bears against the bed support to support the boxspring when placed on the cross bar, the cross bar having a length about equal to the width of the boxspring and opposed ends which extend beyond the bed support when the cross bar is attached to the bed support, each end having a face portion with an elongated slot therein extending lengthwise along a portion of the length of the cross bar and at least one receptacle in the face portion near the elongated slot, the face portions of the opposed ends of the cross bar being on opposed ends of the second leg member, and a pair of brackets, one bracket being at one end of the cross bar and the other bracket being at the other end of the cross bar, each bracket having a connection section made of a malleable material and attached to the cross bar by at least one connector member that extends from the bracket through the elongated slot to allow the bracket to move a slight distance towards and away from the face portion of the cross bar and lengthwise along the elongated slot between an extended position and a retracted position, with the brackets being in extended positions and the boxspring being positioned on the cross bar between the opposed extended brackets, the brackets being each manually moveable to their respective retracted positions to bring the brackets into engagement with the opposed sides of the boxspring positioned on the cross bar, each bracket having substantially an L-shape configuration with a first arm member that is substantially parallel to the face portion of the end to which it is attached, the first arm member terminating at a second arm member which is substantially at a right angle to the first arm member and having a locking element formed in the connection section which extends outward from the underside of the first arm member, the receptacle and its corresponding locking element at each opposed end of the cross bars being in predetermined locations, so that with each bracket in the retracted position each locking element is received in its corresponding receptacle and the distance between the second arm members is approximately equal to the width of the boxspring, the boxspring bearing down on the locking elements to tend to maintain said locking elements in said receptacles, and each of said second arm members engaging the boxspring when the brackets are in the retracted positions, the locking elements each having a predetermined configuration with a sloping portion that facilitates moving the bracket in one direction from the extended position to the retracted position and a stop portion that engages the receptacle and inhibits moving the bracket in the reverse direction from the retracted position to the extended position, (b) manually moving the brackets of the to their respective extended positions, (c) placing the boxspring on the bed support centrally between the extends brackets of the support rails, and (d) manually moving the brackets to their retracted positions so to engage the sides of the boxspring.

DESCRIPTION OF THE DRAWING

The preferred embodiments of this invention, illustrating all its features, will now be discussed in detail. These embodiments depict the novel and non-obvious support rail of this invention as shown in the accompanying drawing, which is for illustrative purposes only. This drawing includes the following figures (FIGS.), with like numerals indicating like parts:

FIG. 2A is an enlarged perspective view taken along line 2A of the right end of the support rail showing the moveable bracket in the extended position.

FIG. 2B is an enlarged perspective view taken along line 2B of the left end of the support rail, with sections broken away, showing the moveable bracket in the extended position.

FIG. 3 is a plan view of the topside of support rail taken along line 3—3 of FIG. 2A.

FIG. 4 is a plan view of the underside support rail taken along line 4—4 of FIG. 2A.

FIG. 5 is a cross-sectional view of the support rail taken along line 5—5 of FIG. 3, showing the locking mechanism disengaged.

FIG. 6 is a plan view of the underside of the support rail similar to FIG. 3 showing the bracket in the retracted position.

FIG. 7 is a cross-sectional view of the support rail taken along line 7—7 of FIG. 6, showing the locking mechanism engaged with the locking element in the receptacle.

FIG. 8 is cross-sectional view of an alternate embodiment of this invention similar to that shown in FIG. 7 with its locking element and receptacle positions reversed from the positions shown.

DETAILED DESCRIPTION OF THE PREFERRED EMBODIMENTS

Figure 1:
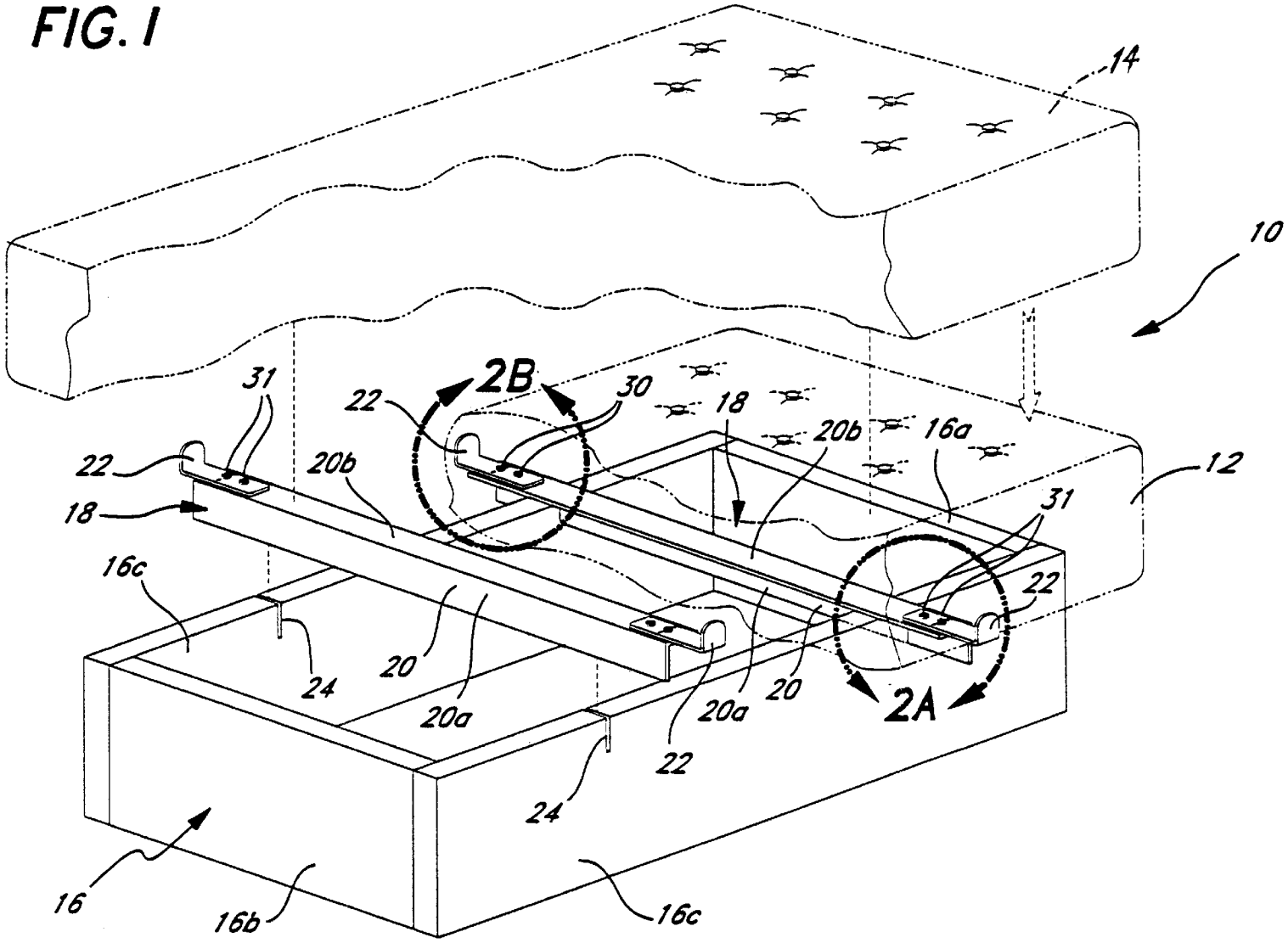
FIG. 1 is a perspective view of a bed supported on a bed frame by a pair of support rails.

As shown in FIG. 1, a bed 10, including a boxspring 12 and mattress 14, is supported on a rectangular bed frame 16 by a pair of support rails 18 extending across the top of the frame. Each support rail 18 comprises an L-shaped cross bar 20 with an L-shaped, moveable bracket 22 attached to each end of the cross bar. The bed frame 16 has a head board 16*a*, a foot board 16*b*, and a pair of side boards 16*c* having opposed ends respectively connected to the foot and head boards. There are opposed grooves 24 in the tops of the side boards 16*c*. The one leg 20*a* of the cross bar 20 fits into the opposed grooves. Another leg 20*b*, attached to the leg 20*a* at substantially a right angle to this leg 20*a*, is adapted to lie on top of the bed frame 16 to support the boxspring 12 placed on the rails 18. In FIG. 1, the brackets 22 are in their extended positions, allowing the boxspring 12 to be centrally positioned between these extended brackets 22. The cross bars 20 and brackets 22 are made of a grade of steel which is malleable.

The cross bars 20, being equal in length, are approximately equal to the width of the boxspring 12. The opposed ends of the cross bars 20 extend beyond the side boards 16*c* of the bed frame 16 when the cross bars are centered on and attached to the bed frame. The sections of the cross bars 20 extending beyond the side boards 16*c* are essentially equal in length. Each end of the cross bars 20 has a face 20*c* with an elongated slot 28 therein extending lengthwise along a portion of the length of the cross bar 20, preferably along the longitudinal axis of the cross bar 20. There preferably are a pair receptacles in the form of a pair of holes 30 in the one leg 20*b* of the cross bar 20 near to the elongated slot 28. The holes 30 straddle the slot 28. Although a pair of holes 30 is preferred, only one hole may be used. The holes 30 are formed using a press to punch out the malleable material adjacent the slot 28.

Figure 2C:
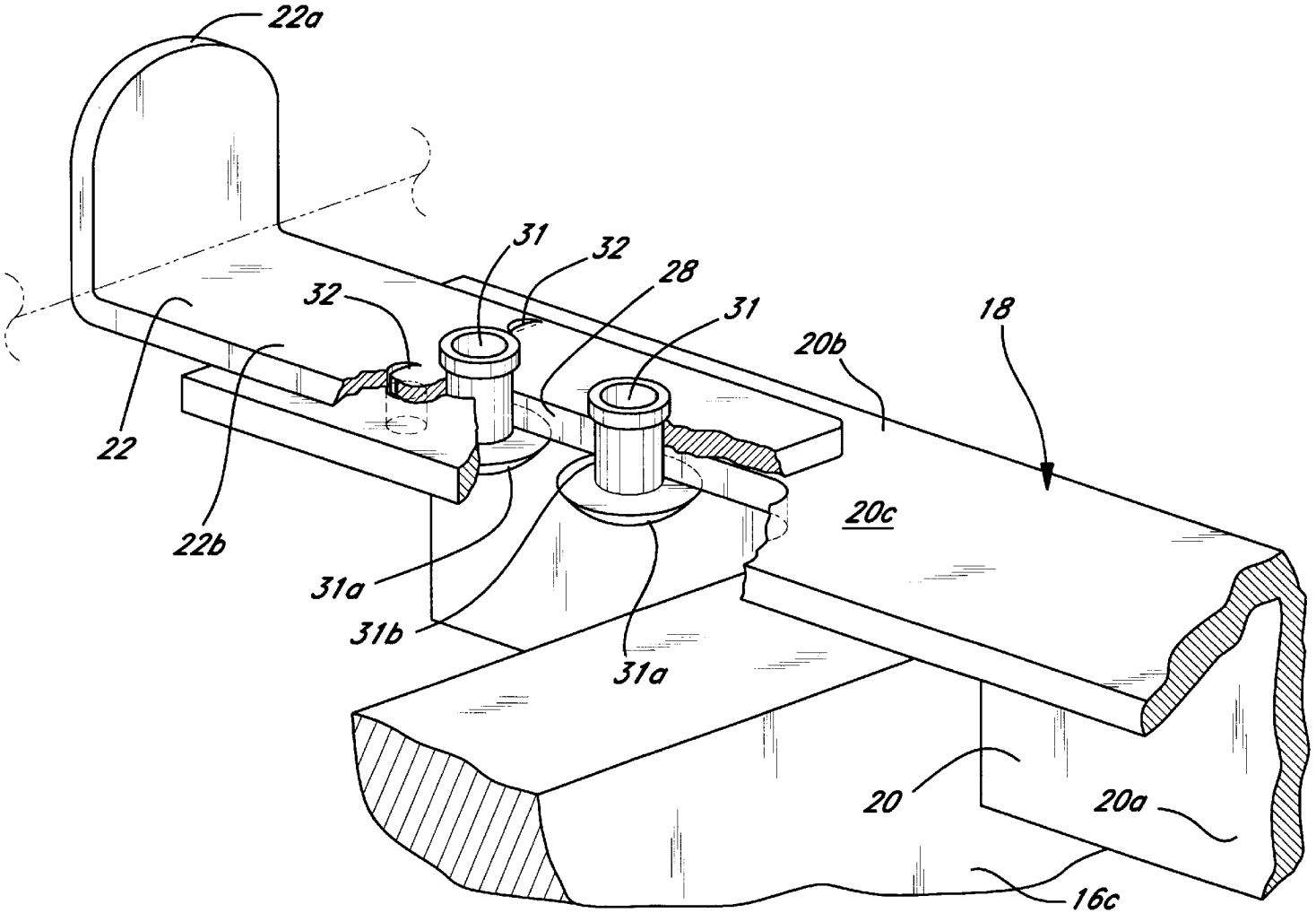
FIG. 2C is an enlarged perspective view taken along line 2C of FIG. 2B.

As best shown in FIGS. 2A and 2B, each bracket 22 has a gripper arm 22*a* formed at a right angle to a connection section 22*b* which is attached to the cross bar 20 by a pair of rivets 31 that extend from the connection section 22*b* through the elongated slot 28. Only one rivet 31 may be used. The underside of the connection section 22*b* of each bracket 22 is substantially parallel to the face 20*c* of the end of the cross bar 20 to which the bracket 22 is attached. There are a pair of locking fingers 32 straddling the slot 28 (FIG. 5) formed in the malleable material of the connection section 22*b* by using a press to deform and partially cut through this malleable material. As best illustrated in FIG. 7, each locking finger 32 extends outward from the underside of the connection section 22*b* of the bracket 22. Each locking finger 32 has a predetermined configuration with a sloping portion 32*a* that facilitates moving the bracket 22 in one direction (arrow a, FIG. 5) from the extended position to the retracted position and a stop portion 32*b* that engages the hole 30 and inhibits moving the bracket 22 in the reverse direction (arrow b, FIG. 7) from the retracted position to the extended position.

Each rivet 31 has an enlarged head 31*a* adjacent the underside of the cross bar 20 and a connecting body member 31*b* extending into and through the slot 28 and fixedly attached to the connection section 22*b* by a tail 31*c*. As the bracket 22 is moved between the extended position (FIGS. 4 and 5) and retracted position (FIGS. 6 and 7), the slot 28 guides the body member 31*b* to move laterally in the slot 28 and the head 31*a* of the rivet 31 rides along the underside of the one leg 20*b* of the cross bar 20. This one leg 20*b* of each of the cross bars 20 has a thickness of about ⅛ inch, and the length of the connecting body member 31*b* of the rivets 31 is slightly longer than this thickness of the leg 20*b*, so that the bracket 22 may be moved reciprocally a slight distance towards and away from the face 20*c* of the cross bar 20 sufficient to lift the locking fingers 32 from their corresponding holes 30, thereby assisting in disengaging the locking mechanism when desired.

With the brackets 22 in extended positions and the boxspring 12 positioned on the rails 18 between opposed extended brackets, the brackets are each manually moveable to their respective retracted positions to bring the brackets into engagement with the opposed sides of the boxspring 12 positioned on the cross bar 20. As shown in FIG. 5, because of the shape of the locking fingers 32, the undersides of the connection sections 22*b* of the brackets 22 are slightly above the face 20*c* of the legs 20*b* of the cross bars 20, permitting the bracket 22 to slide inward towards the boxspring 12 with minimal force. When the fingers 32 are opposite their corresponding holes 30, the brackets 22 move downward towards the legs 20*b* of the cross bars 20 and slip into their corresponding holes 30. With each bracket 22 on each rail 18 in the retracted position, each gripper arm 22*a* engages the sides of boxspring 12. Under this condition where the brackets 22 are in their retracted positions, the holes 30 and the locking fingers 32 are precisely located so that (1) the locking fingers 32 are received in their corresponding holes 30, and (2) the distance between the gripper arms 22*a* for each pair of brackets 22 on each rail 18 is approximately equal to the width of the boxspring 12. The boxspring 12 bears down on the locking fingers 32 to tend to maintain these locking fingers 32 in the holes 30. Consequently, it is unlikely that the locking mechanism of the fingers 32 in the holes 30 will accidently disengage. Only when the weight of the boxspring 12 is lifted off the brackets 22 and the brackets lifted upward slightly, may the fingers 32 then be easily disengaged from their corresponding holes 30.

Although a pair of rivets 31, a pair of fingers 32, and a pair of corresponding holes 30 are illustrated, only one rivet 31, one locking finger 32 and corresponding one hole 30 may be used. Moreover, the relative positions of the locking fingers 32 and holes 30 may be changed as illustrated in FIG. 8. In this embodiment of the invention the locking fingers 32 are formed in the one leg 20*b* of the cross bar 20, and its corresponding hole 30 is formed in the bracket 22. It is also possible to employ as receptacles for the fingers 32 indentations rather than a hole 30, but a hole is preferred.

SCOPE OF THE INVENTION

The above presents a description of the best mode contemplated of carrying out the present invention, and of the manner and process of making and using it, in such full, clear, concise, and exact terms as to enable any person skilled in the art to which it pertains to make and use this invention. This invention is, however, susceptible to modifications and alternate constructions from that discussed above which are fully equivalent. Consequently, it is not the intention to limit this invention to the particular embodiments disclosed. On the contrary, the intention is to cover all modifications and alternate constructions coming within the spirit and scope of the invention as generally expressed by the following claims, which particularly point out and distinctly claim the subject matter of this invention:

I claim:

1. A support rail for a boxspring, including a cross bar having opposed ends, each end having a face portion and a receptacle in said face portion, and a pair of brackets, one bracket being mounted to move laterally over the face portion of one end of the cross bar between an extended position and a retracted position and the other bracket being mounted to move laterally over the face portion of the other end of the cross bar between an extended position and a retracted position, each bracket attached to the cross bar to move towards and away from the face portion to which said bracket is mounted without bending the bracket and each bracket having a connection section made of a malleable material, a locking element formed in the connection section by pressing a portion of the connection section and partially cutting through said malleable material, and a gripper arm at an end of the connection section for engaging the boxspring, each locking element extending outward from said connection section toward the face portion at the end of the cross bar to which said locking element is attached and positioned at a predetermined location to be received in the receptacle in said end when said bracket is moved into the retracted position and is moved toward said face portion, said cross bar having a predetermined thickness and an underside and there being an elongated slot in each end of the cross bar extending lengthwise along a portion of the length of the cross bar and at least one rivet member extending from the connection section of each bracket, each rivet member having an enlarged head adjacent the underside of the cross bar and a connecting member extending into and through its respective slot to enable the bracket to move reciprocally in the slot between said extended position and retracted position, said connecting member being slightly longer than said thickness of the cross bar so that the bracket may be moved a slight distance towards and away from the face portion of the end to which it is attached to assist in disengaging the locking element from the receptacle.

2. The support rail of claim 1 where each receptacle is a hole that extends from the face portion through the end in which it is formed.

3. The support rail of claim 1 where the locking element has a predetermined configuration with a sloping portion that facilitates moving the bracket in one direction from the extended position to the retracted position and a stop portion that engages the receptacle and inhibits moving the bracket in the reverse direction from the retracted position to the extended position.

4. A support rail for a boxspring including a cross bar having a predetermined length and opposed ends, each end having a face portion with an elongated slot therein extending lengthwise along a portion of the length of the cross bar and at least one receptacle in said face portion near the elongated slot, and a pair of brackets, one bracket being mounted to move laterally over the face portion of one end of the cross bar between an extended position and a retracted position and the other bracket being mounted to move laterally over the face portion of the other end of the cross bar between an extended position and a retracted position, each bracket being attached to the cross bar by at least one connector member that extends through the elongated slot to allow the bracket to move a slight distance reciprocally towards and away from the face portion of the cross bar without bending the bracket and lengthwise along the elongated slot between an extended position and a retracted position without bending the bracket, and each bracket having substantially an L-shape configuration with a first arm member having a connection section made of a malleable material with an underside that is substantially parallel to the face portion of the end to which the bracket is attached, a locking element formed in the connection section by pressing a portion of the connection section and partially cutting through said malleable material to extend outward from the underside of the first arm member, and a second gripper arm member which is substantially at a right angle to the first arm member for engaging the boxspring, said receptacle and its corresponding locking element at each opposed end of the cross bars being in predetermined locations, so that with each bracket in the retracted position each locking element is received in its corresponding receptacle so that the second gripper arm members are positioned to engage the boxspring, the cross bar having a predetermined thickness and an underside and there being an elongated slot in each end of the cross bar extending lengthwise along a portion of the length of the cross bar and each said connector member comprising at least one rivet member extending from the connection section of each bracket, said rivet member having an enlarged head adjacent the underside of the cross bar and a connecting member extending into and through said slot to enable the bracket to move laterally in the slot between said extended position and retracted position, said connecting member being slightly longer than said thickness of the cross bar so that the bracket may be moved a slight distance towards and away from the face portion of the cross bar to assist in disengaging the locking element from the receptacle.

5. The support rail of claim 4 where the cross bar has a substantially L-shape configuration with a first leg member adapted to be removably inserted into a pair of opposed aligned slots in a bed support and a second leg member having opposed ends and attached to the first leg member at substantially a right angle to the first leg member and adapted to lie on top of a bed support to support the boxspring when placed on the cross bar, said face portions of the opposed ends of the cross bar being on said opposed ends of the second leg member.

6. The support rail of claim 4 where the locking element has a predetermined configuration with a sloping portion that facilitates moving the bracket in one direction from the extended position to the retracted position and a stop portion that engages the receptacle and inhibits moving the bracket in the reverse direction from the retracted position to the extended position.

7. The support rail of claim 4 where each receptacle is a hole that extends from the face portion through the end in which it is formed.

8. A support rail for a boxspring, including one component comprising a cross bar having opposed ends, and another component comprising a pair of brackets, one bracket being attached to one end of the cross bar and the other bracket being attached to the other end of the cross bar, an end section of each of end of the cross bar and a connection section of each of the brackets being made of a malleable material, each bracket being attached to the cross bar to move towards and away from the face portion to which said bracket is mounted without bending the bracket and mounted to move laterally without bending across the end to which it is attached between an extended position and a retracted position, said cross bar and brackets being releasably interlocked together with the brackets in the retracted positions by a lock mechanism including a locking element and a receptacle, with the receptacle formed in the malleable material of either component and the locking element formed in the malleable material of the other component by pressing a portion of the malleable material and partially cutting through said malleable material, each said locking element extending outward and positioned at a predetermined location to be received in its corresponding receptacle when said brackets are moved into the retracted positions, the cross bar having a predetermined thickness and an underside and there being an elongated slot in each end of the cross bar extending lengthwise along a portion of the length of the cross bar and at least one rivet member extending from the connection section of each bracket, each rivet member having an enlarged head adjacent the underside of the cross bar and a connecting member extending into and through its respective slot to enable the bracket to move reciprocally in the slot between said extended position and retracted position, said connecting member being slightly longer than said thickness of the cross bar so that the bracket may be moved a slight distance towards and away from the face portion of the end to which it is attached to assist in disengaging the locking element from the receptacle, and each bracket having a gripper arm for engaging the boxspring.

9. The support rail of claim 8 where each receptacle is a hole in the component in which it is formed.

10. The support rail of claim 9 where each locking element has a predetermined configuration with a sloping portion that facilitates moving the bracket in one direction from the extended position to the retracted position and a stop portion that engages the receptacle and inhibits moving the bracket in the reverse direction from the retracted position to the extended position.

11. A support rail for a boxspring, including one component comprising a cross bar having opposed ends, each having a face portion, and another component comprising a pair of brackets, one bracket being attached to one end of the cross bar and the other bracket being attached to the other end of the cross bar, each bracket being attached to the cross bar to move towards and away from the face portion to which said bracket is mounted and to move laterally across the end to which it is attached between an extended position and a retracted position, said cross bar and brackets being releasably interlocked together with the brackets in the retracted positions by a lock mechanism including a locking element and a receptacle, with the receptacle formed in either component and the locking element formed in the other component, each said locking element extending outward and positioned at a predetermined location to be received in its corresponding receptacle when said brackets are moved into the retracted positions, the cross bar having a predetermined thickness and an underside and there being an elongated slot in each end of the cross bar extending lengthwise along a portion of the length of the cross bar and at least one rivet member extending from each bracket, each rivet member having an enlarged head adjacent the underside of the cross bar and a connecting member extending into and through its respective slot to enable the bracket to move reciprocally in the slot between said extended position and retracted position, said connecting member being slightly longer than said thickness of the cross bar so that the bracket may be moved a slight distance towards and away from the face portion of the end to which it is attached to assist in disengaging the locking element from the receptacle, and each bracket having a gripper arm for engaging the boxspring.

* * * * *